US007641064B2

(12) United States Patent
Robinson

(10) Patent No.: US 7,641,064 B2
(45) Date of Patent: Jan. 5, 2010

(54) CHILD-RESISTANT SQUEEZE-AND-TURN CLOSURE AND CONTAINER PACKAGE

(75) Inventor: Philip J. Robinson, Sylvania, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 872 days.

(21) Appl. No.: 10/965,553

(22) Filed: Oct. 13, 2004

(65) Prior Publication Data

US 2006/0108312 A1 May 25, 2006

(51) Int. Cl.
*B55D 55/02* (2006.01)

(52) U.S. Cl. ..... 215/216; 215/221; 215/219

(58) Field of Classification Search ..... 215/10, 215/210, 216, 219, 221, 305; 220/380
See application file for complete search history.

(56) References Cited

U.S. PATENT DOCUMENTS

| | | | | |
|---|---|---|---|---|
| 3,612,323 | A | 10/1971 | Malick | |
| 3,642,161 | A | 2/1972 | Stroud | |
| 3,923,181 | A | 12/1975 | Libit | |
| 3,967,745 | A | 7/1976 | Julian | |
| 4,351,442 | A | 9/1982 | Summers | |
| 4,464,316 | A * | 8/1984 | Michaels | 261/121.1 |
| 4,479,585 | A | 10/1984 | Sandhaus | |
| 4,579,239 | A | 4/1986 | Hart | |
| 4,723,669 | A | 2/1988 | Barriac | |
| 4,752,014 | A | 6/1988 | House et al. | |
| 5,383,564 | A | 1/1995 | Hamilton et al. | |
| 5,449,077 | A | 9/1995 | Seidler | |
| 5,560,505 | A | 10/1996 | Schneider et al. | |
| 5,603,421 | A | 2/1997 | Opresco | |
| 5,671,853 | A | 9/1997 | Herr | |

(Continued)

FOREIGN PATENT DOCUMENTS

| | | |
|---|---|---|
| CH | 613907 | 10/1979 |

(Continued)

OTHER PUBLICATIONS

U.S. Appl. No. 10/603,470, filed Jun. 25, 2003 Title: Child-Resistant Squeeze-and-Turn Closure and Container Package.

*Primary Examiner*—Anthony Stashick
*Assistant Examiner*—James N Smalley
(74) *Attorney, Agent, or Firm*—Reising Ethington PC

(57) ABSTRACT

A child-resistant package includes a container having a finish with at least one external thread, at least one axial lug on a shoulder spaced from the thread and an external abutment on the finish adjacent to the lug. A closure of integrally molded plastic construction includes a base wall, a peripheral outer wall, and an inner wall spaced from the outer wall and having at least one internal thread for securement to the container finish. The outer wall has diametrically opposed gaps, and the inner wall extends axially in radial alignment with the gaps for circumferential abutment with the at least one lug on the container. The inner wall is flexible inwardly for clearing the lug between the lug and the external abutment, and for permitting removal of the closure from the container finish. The external abutment preferably is in the form of an external bead that extends circumferentially around the finish in alignment with an edge of the lug.

9 Claims, 5 Drawing Sheets

U.S. PATENT DOCUMENTS 5,722,546 A 3/1998 Briere
5,727,703 A 3/1998 Fuchs
5,865,330 A 2/1999 Buono
5,908,125 A 6/1999 Opresco
5,927,526 A 7/1999 Herr
5,979,681 A 11/1999 Varlet et al.
6,036,036 A 3/2000 Bilani et al.
6,112,921 A 9/2000 Robinson
6,296,130 B1 10/2001 Forsyth et al.
6,357,615 B1 3/2002 Herr
6,508,373 B1 * 1/2003 Robinson ..... 215/209

FOREIGN PATENT DOCUMENTS

GB 2138410 A 10/1984

* cited by examiner

CHILD-RESISTANT SQUEEZE-AND-TURN CLOSURE AND CONTAINER PACKAGE

The present invention relates to child-resistant closures, containers and packages of the type in which a user must squeeze opposite sides of the closure to be able to turn the closure and remove the closure from the container. Such closures and packages are commonly referred to as squeeze-and-turn closures and packages.

BACKGROUND AND SUMMARY OF THE INVENTION

U.S. Pat. No. 6,112,921 discloses a child-resistant closure, container and package in which the closure is a dual-wall closure having an inner wall with internal threads for receipt on a container finish and an outer wall for enclosing the child-resistance structure. The outer wall has diametrically opposed gaps, and finger pads extend from the inner wall in alignment with the gaps. When the closure is threaded clockwise onto the finish of the container, the finger pads cam inside of lugs on the shoulder of the container. Stop faces on the lugs prevent counterclockwise removal of the closure unless the finger pads are squeezed radially inwardly so that the pads clear the insides of the lugs. It is a general object of the present invention to provide a child-resistant closure, container and package that embody one or more improvements on the closure, container and package disclosed in the noted patent.

A child-resistant package in accordance with one aspect of the present includes a container having a finish with at least one external thread (or thread segment), at least one axial lug on a shoulder spaced from the thread and an external abutment on the finish adjacent to the lug. A closure of integrally molded plastic construction includes a base wall, a peripheral outer wall, and an inner wall spaced from the outer wall and having at least one internal thread (or thread segment) for securement to the container finish. The outer wall has diametrically opposed gaps, and the inner wall extends axially in radial alignment with the gaps for circumferential abutment with the at least one lug on the container. The inner wall is flexible inwardly for clearing the lug between the lug and the external abutment, and for permitting removal of the closure from the container finish. The external abutment preferably is in the form of an external bead that extends circumferentially around the finish in alignment with an edge of the lug.

In accordance with another aspect of the present invention, the child-resistant closure has external ribs on the finger pads that extend from the inner wall of the closure. The ribs do not extend entirely to the bottom of the finger pads, so that the bottoms of the pads can clear the lugs on the container shoulder beneath the ribs, while the ribs prevent the fingers of a user from stubbing on the container lugs. The ribs also increase the mechanical advantage on pressing the pads radially inwardly to clear the lugs, which can assist elderly users in removing the closure. The ribs have an additional advantage in that, by extending the ribs upwardly along the outer surface of the pads and the inner wall, the finger pads can be made stiffer for different sizes or different materials of the closure. The ends of the ribs are interconnected by an arcuate radially outwardly extending shelf to prevent the user's fingers from engaging the ends of the ribs.

A container for a child-resistant package in accordance with a third aspect of the invention includes a body having a finish with at least one external thread, at least one axial lug on a shoulder spaced from the thread and an external abutment on the finish adjacent to the lug. The external abutment in the preferred embodiment includes a circumferential bead radially inwardly aligned with the edge of the lug.

BRIEF DESCRIPTION OF THE DRAWINGS

The invention, together with additional objects, features, advantages and aspects thereof, will be best understood from the following description, the appended claims and the accompanying drawings, in which:

DETAILED DESCRIPTION OF PREFERRED EMBODIMENTS

The disclosure of above-noted U.S. Pat. No. 6,112,921 is incorporated herein by reference.

Figure 1:
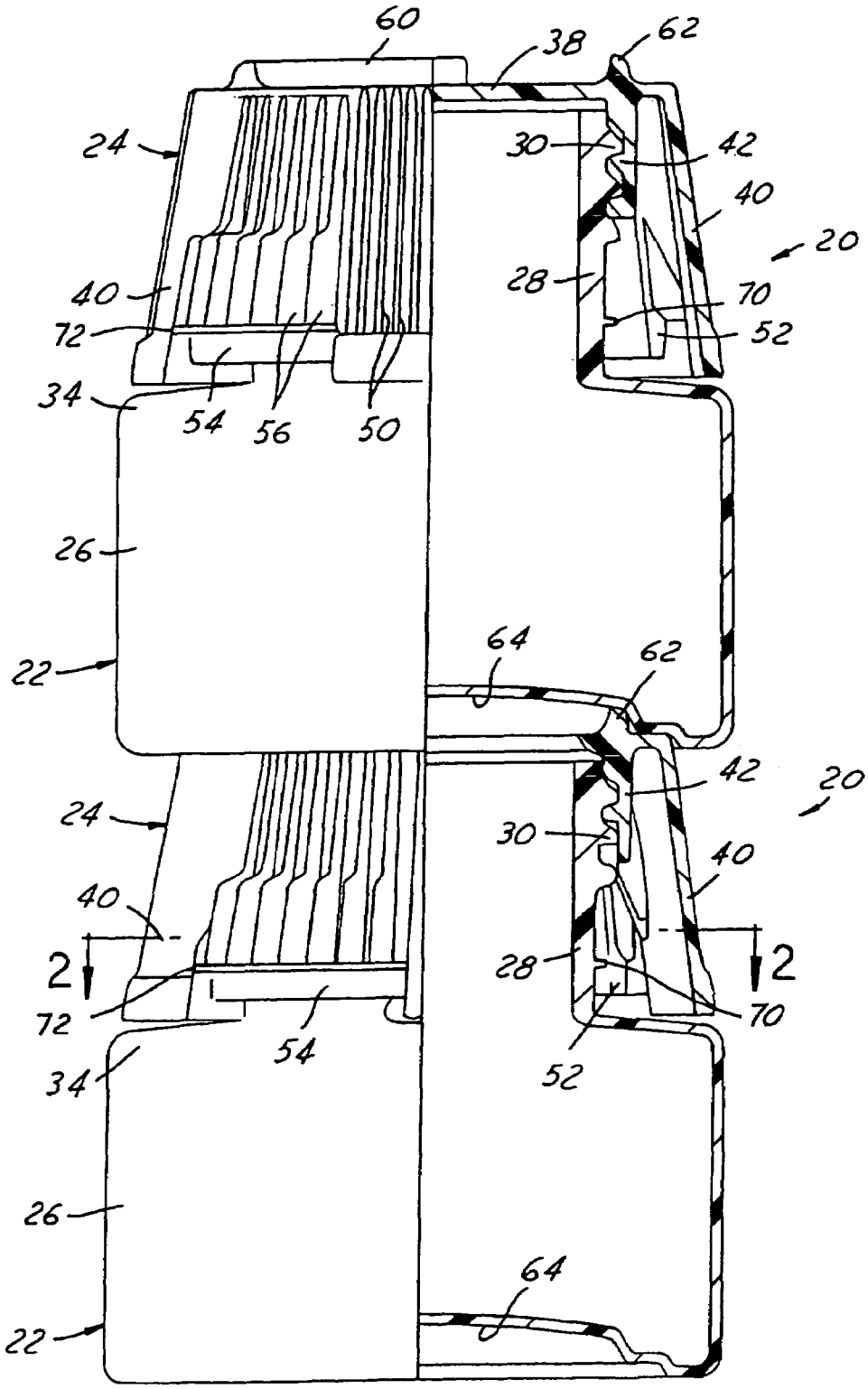
FIG. 1 is a partially sectioned elevational view of two child-resistant packages in accordance with an exemplary presently preferred embodiment of the invention stacked one upon the other.
Figure 6:
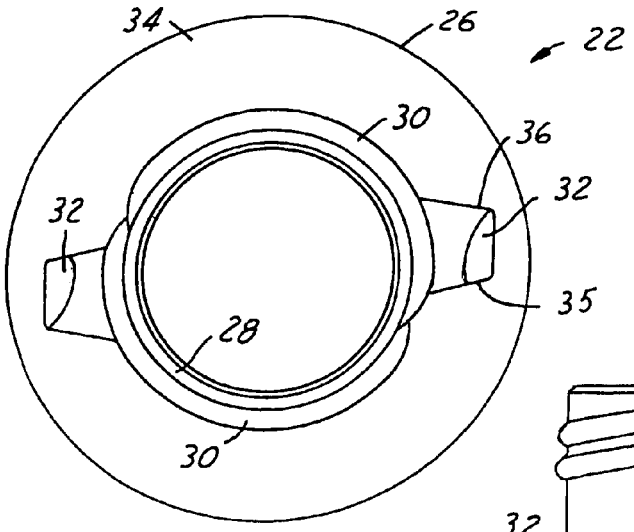
FIG. 6 is a top plan view of the container in FIG. 5.
Figure 5:
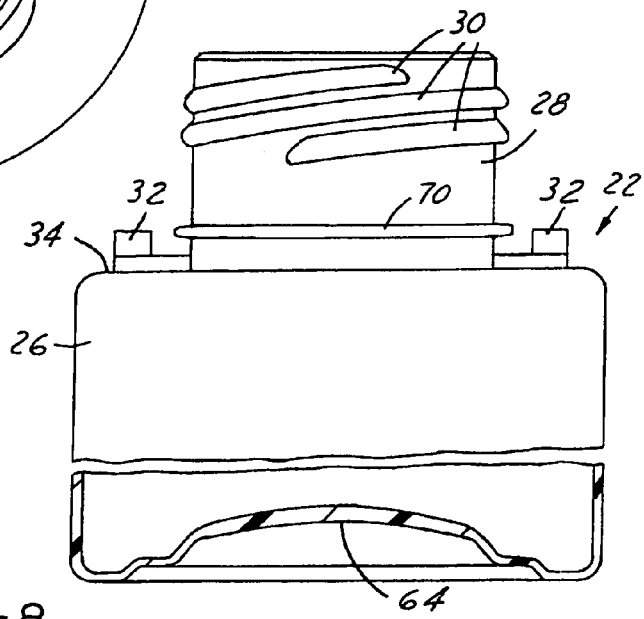
FIG. 5 is a partially sectioned elevational view of the container in the package of FIG. 1.

FIG. 1 illustrates a pair of closure and container packages 20, in accordance with one exemplary but presently preferred embodiment of the invention, stacked one upon another. Each package 20 includes a container 22 and a closure 24. Container 22 (FIGS. 1 and 5-6) includes a body 26 from which a finish 28 extends. Finish 28 is generally of cylindrical construction, and has one or more external threads (or thread segments) 30 for securement of closure 24. A pair of diametrically opposed lugs 32 extend axially from a shoulder 34 of container 22. Each lug 32 has an abutment face 35 facing in a clockwise direction (FIG. 6), and a cam edge 36 facing in a counterclockwise direction. Lugs 32 are spaced radially outwardly from finish 28 for reasons to be described. An external abutment 70 is disposed on finish 28 adjacent to each lug 32. External abutment 70 preferably is in the form of a circumferential bead that extends around finish 28. Bead 70 preferably is circumferentially continuous, and preferably is radially inwardly aligned with the upper edges of lugs 32 as best seen in FIG. 5. Bead 70 preferably lies in a plane perpendicular to the axis of finish 28.

Figure 2:
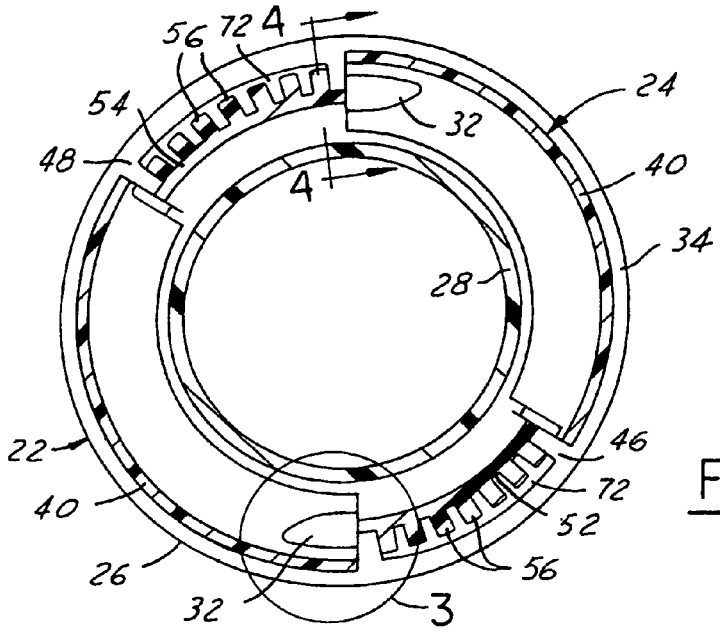
FIG. 2 is a sectional view taken substantially along the line 2-2 in FIG. 1.
Figure 7:
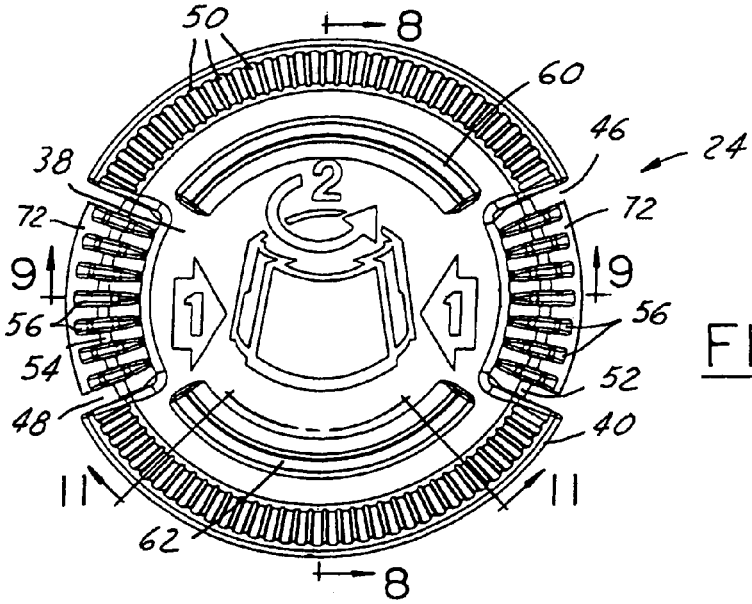
FIG. 7 is a top plan view of the closure in the package of FIG. 1.

Closure 24 (FIGS. 1 and 7-11) includes a base wall 38 from which an outer peripheral wall or skirt 40 axially extends. Base wall 38 has a circular periphery in the embodiment illustrated in the drawings, and wall 40 is of frustoconical construction in the illustrated embodiment. Wall 40 could be of non-circular cross section in other embodiments of the invention to blend with the geometry of the container body. An inner wall or skirt 42 extends axially from the underside of base wall 38 within outer skirt 40. Inner wall 42 has one or more internal threads (or thread segments) 44 for securing closure 24 to external threads 38 of container finish 28. Outer wall 40 is not circumferentially continuous, but has opposed edges that form a pair of diametrically spaced gaps 46, 48 (FIGS. 2 and 7). Decoration in the form of ribs may extend axially along the outer surface of outer wall 40.

Figure 8:
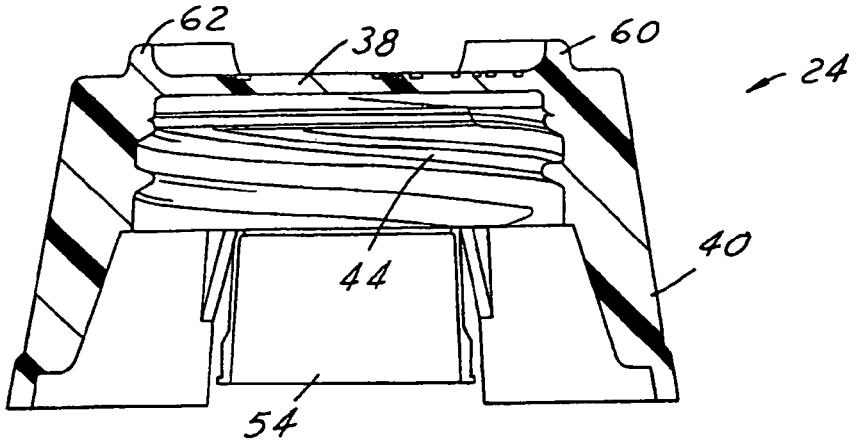
FIGS. 8 and 9 are sectional views taken substantially along the respective lines 8-8 and 9-9 in FIG. 7.
Figure 9:
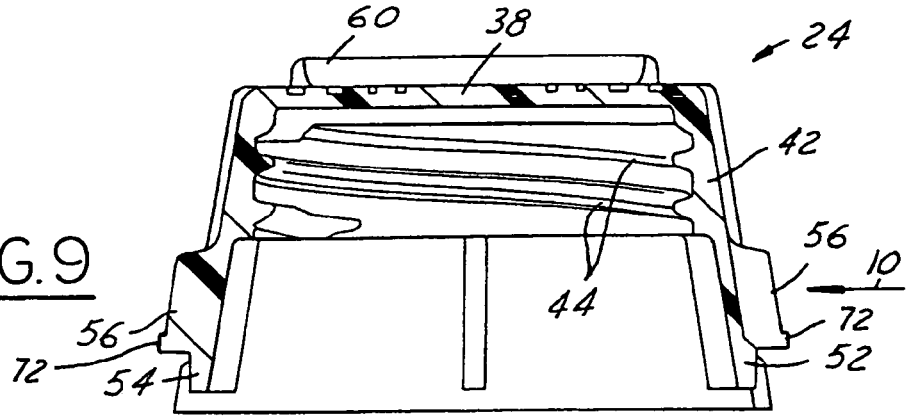
Figure 10:
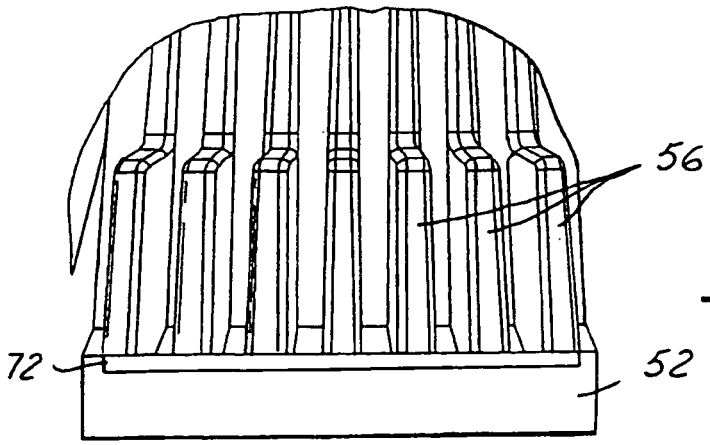
FIG. 10 is a fragmentary elevational view taken from the direction 10 in FIG. 9.
Figure 11:
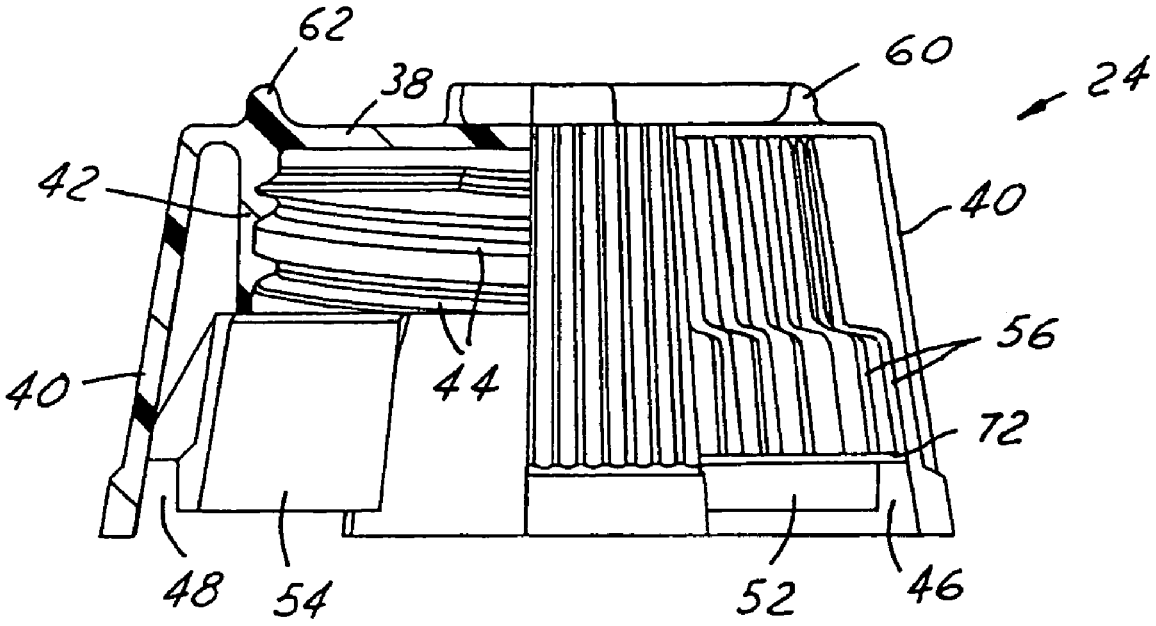
FIG. 11 is a partially sectioned elevational view taken substantially along the line 11-11 in FIG. 7.

As best seen in FIGS. 2 and 9, a pair of diametrically opposed finger tabs or pads 52, 54 extend from inner wall 42 in an axial direction parallel to but spaced radially inwardly from outer wall 40. As best seen in FIGS. 7, 8 and 11, these finger pads 52, 54 are in radial alignment with gaps 46,48 in outer wall 40. A plurality of circumferentially spaced external ribs 56 extend axially along each finger tab 52, 54. In the preferred embodiment, ribs 56 extend from a position adjacent to closure base wall 38 to a position adjacent to but spaced from the lower edges of the finger pads, being thickest in the radial direction (FIG. 9) in the portions of pads 52, 54 that extend from inner wall 42. A flat arcuate radially outwardly extending shelf 72 interconnects the lower ends of ribs 56. Shelves 72 lie in a common plane perpendicular to the axis of inner wall 42.

Figure 3:
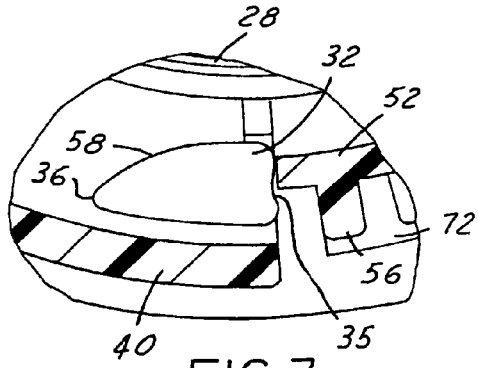
FIG. 3 is a fragmentary view on an enlarged scale of the portion of FIG. 2 within the area 3.
Figure 4:
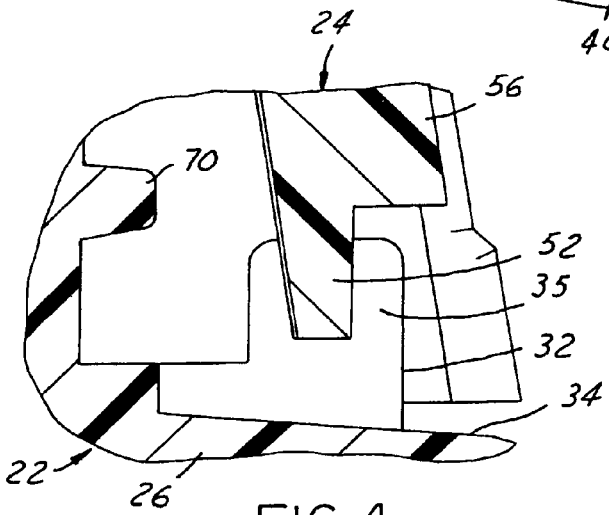
FIG. 4 is a fragmentary sectional view taken substantially along the line 4-4 in FIG. 2.

To apply closure 24 to container finish 28, inner wall 42 is positioned over the container finish and the closure is rotated clockwise with respect to the container finish (or the container is rotated counterclockwise with respect to the closure). The lower ends of finger pads 56 are positioned radially of the axis of rotation (the axes of finish 28 and wall 42) to engage the cam edges 36 of lugs 32. The inner face 58 of each lug 38 is rounded so as to cam finger pads 52, 54 radially inwardly during clockwise rotation of the closure onto the container finish, so that the finger pads clear the lugs. When it is attempted to remove the closure by rotating the closure counterclockwise with respect to the container finish (or rotating the container clockwise with respect to the closure), finger pads 52, 54 are brought into engagement with abutment faces 35 of stop lugs 32, as best seen in FIGS. 2-4. Finger pads 52, 54 must be manually pressed radially inwardly to clear lugs 32 in the spaces between lugs 32 and the outside surface of container finish 28. Provision of a pocket or concavity on the abutment face 35 of each lug 32 helps make the pads self-centering on the lugs in child-resistant operation, which helps prevent inadvertent movement of the finger pad in the event of brute-force turning of the closure with respect to the container finish.

Provision of ribs 56, coupled with the fact that the ribs stop short of the lower edge of the finger pads 52, 54, helps prevent the fingers of a user from stubbing against lugs 36 when the closure is removed from the container. Ribs 56 also increase the mechanical advantage on pressing the finger pads radially inwardly to clear the lugs, which can assist elderly users in removing the closure. It will be noted in the drawings that ribs 56 are thickest outside of the flexible portions of finger pads 52, 54, and are relatively thin along the outside surface of inner wall 42. The radial thicker portions of ribs 56 may be extended upwardly along wall 42 to make the finger pads stiffer for different sizes or different materials of the closure. Abutment bead 70 limits radial inward movement of pads 52, 54, which cooperation with shelves 72 further to prevent the user's fingers from stubbing on lugs 32.

A pair of arcuate ribs 60, 62 extend axially upwardly from the upper surface of closure base wall 38. These ribs 60, 62 extend angularly around the base wall substantially in alignment with the segmented portions of outer wall 40, as best seen in FIG. 7. These ribs 60, 62, which are concentric with the central axis of the closure, form a projection or protrusion that is adapted to be received within a depression or pocket 64 on the bottom of container body 26 for stacking the packages one upon another, as shown in FIG. 1.

There have thus been disclosed a child-resistant squeeze-and-turn closure, container and package that fully satisfy all of the objects and aims previously set forth. The invention has been disclosed in conjunction with an exemplary presently preferred embodiment thereof, and a number of modifications and variations have been discussed. Other modifications and variations will readily suggest themselves to persons of ordinary skill in the art. The invention is intended to embrace all such modifications and variations as fall within the spirit and broad scope of the appended claims.

The invention claimed is:

1. A child-resistant package that includes:

a container having a finish with at least one external thread, at least one axial lug on a shoulder spaced from said thread and an external abutment on said finish radially adjacent to said lug and axially spaced from said at least one external thread and from said shoulder, and a closure of integrally molded plastic construction and including:

a base wall, a peripheral outer wall, and an inner wall spaced from said outer wall and having at least one internal thread from securement to the container finish, said outer wall having diametrically opposed circumferential gaps, said inner wall extending in radial alignment with said gaps for circumferential abutment with said container lug and having axially extending ribs on an outer surface of said inner wall within said gaps, said inner wall being flexible inwardly for clearing said lug between said lug and said external abutment bead, and permitting removal of said closure from said container finish.

2. The package set forth in claim 1 wherein said external abutment bead is circumferentially continuous, extending circumferentially around said finish.

3. The package set forth in claim 2 wherein said ribs terminate short of an edge of said inner wall and said closure includes a shelf interconnecting ends of said ribs spaced from said base wall.

4. The package set forth in claim 1 wherein said lug has a concave abutment face for engagement by said inner wall absent inward flexure of said inner wall to clear said lug.

5. The package set forth in claim 1 wherein said external abutment bead is radially inwardly aligned with said lug.

6. The package set forth in claim 5 wherein said external abutment bead is radially inwardly aligned with an upper edge of said lug.

7. The package set forth in claim 6 wherein said external abutment bead includes an external bead extending circumferentially around said finish.

8. A child-resistant package that includes:

a container having a finish with at least one external thread and at least one axial lug on a shoulder spaced from said thread, and a closure of integrally molded plastic construction and including:

a base wall, a peripheral outer wall, and an inner wall spaced from said outer wall and having at least one internal thread from securement to the container finish, said outer wall having diametrically opposed circumferential gaps, said inner wall extending in radial alignment with said gaps for circumferential abutment with said container lug and having axially extending ribs on an outer surface of said inner wall within said gaps, said ribs having ends spaced from an edge of said inner wall and connected by an arcuate radially outwardly extending shelf, said inner wall being flexible inwardly for clearing said lug and permitting removal of said closure from said container finish, wherein said container finish has an external abutment bead radially adjacent to said lug and axially spaced from said at least one external thread and from said shoulder, said inner wall being flexible inwardly for clearing said lug between said lug and said external abutment bead.

9. The package set forth in claim 8 wherein said external abutment bead is circumferentially continuous, extending circumferentially around said finish.

* * * * *

UNITED STATES PATENT AND TRADEMARK OFFICE

CERTIFICATE OF CORRECTION

PATENT NO. : 7,641,064 B2
APPLICATION NO. : 10/965553
DATED : January 5, 2010
INVENTOR(S) : Philip J. Robinson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1322 days.

Signed and Sealed this

Sixteenth Day of November, 2010

David J. Kappos

David J. Kappos
*Director of the United States Patent and Trademark Office*